US008926206B2

(12) United States Patent
Suzuki et al.

(10) Patent No.: US 8,926,206 B2
(45) Date of Patent: Jan. 6, 2015

(54) APPLICATOR-EQUIPPED CONTAINER

(75) Inventors: Kazuo Suzuki, Tokyo (JP); Satoshi Sakamoto, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 466 days.

(21) Appl. No.: 13/265,577

(22) PCT Filed: Apr. 15, 2010

(86) PCT No.: PCT/JP2010/002746
§ 371 (c)(1),
(2), (4) Date: Oct. 21, 2011

(87) PCT Pub. No.: WO2010/125758
PCT Pub. Date: Nov. 4, 2010

(65) Prior Publication Data

US 2012/0039660 A1 Feb. 16, 2012

(30) Foreign Application Priority Data

Apr. 30, 2009 (JP) ..... 2009-111462

(51) Int. Cl.
*A46B 11/00* (2006.01)
*A45D 40/26* (2006.01)

(52) U.S. Cl.
CPC ..... *A45D 40/267* (2013.01)
USPC ..... 401/122; 401/121

(58) Field of Classification Search
CPC . A45D 40/262; A45D 40/264; A45D 40/265; A45D 40/267; A45D 40/268
USPC ..... 401/121, 122, 126–130
See application file for complete search history.

(56) References Cited

U.S. PATENT DOCUMENTS 4,403,624 A * 9/1983 Montgomery ..... 132/218
4,628,950 A * 12/1986 Bitzer ..... 132/218
5,349,972 A * 9/1994 Dirksing et al. ..... 132/218

(Continued)

FOREIGN PATENT DOCUMENTS

CN 1572177 A 2/2005
CN 101185542 A 5/2008

(Continued)

OTHER PUBLICATIONS

Jun. 11, 2013 Office Action issued in Japanese Patent Application No. 2009-111462 (with translation).

(Continued)

*Primary Examiner* — David Walcak
(74) *Attorney, Agent, or Firm* — Oliff PLC

(57) ABSTRACT

An applicator-equipped container capable of rubbing off extra contents when extracting the applicator from a container body and of preventing pressure of the inner portion of the container body from excessively increasing when inserting the applicator is provided. The applicator-equipped container includes: a container body that contains contents; an applicator that is inserted in the container body from an inlet of the container body; and an annular wiping piece that is disposed in the container body, and is elastically deformable so that the rod of the applicator is inserted into an inner periphery of the wiping piece is rubbed to and comes into contact with the outer periphery of a rod, wherein a protrusion protruding to the inside of an inner edge of the wiping piece is provided in the inner periphery of the wiping piece.

18 Claims, 10 Drawing Sheets

(56) References Cited

U.S. PATENT DOCUMENTS

| | | | | |
|---|---|---|---|---|
| 5,597,254 | A * | 1/1997 | Vasas | 401/122 |
| 5,875,791 | A | 3/1999 | Sheffler et al. | |
| 6,502,584 | B1 | 1/2003 | Fordham | |
| 6,974,271 | B2 * | 12/2005 | Wainer | 401/122 |
| 2007/0127974 | A1 | 6/2007 | Chang et al. | |

FOREIGN PATENT DOCUMENTS

| | | | |
|---|---|---|---|
| CN | 101217898 | A | 7/2008 |
| JP | U-60-126109 | | 8/1985 |
| JP | U-62-127214 | | 8/1987 |
| JP | U-63-169010 | | 11/1988 |
| JP | U-3-17721 | | 2/1991 |
| JP | A-2001-061547 | | 3/2001 |
| JP | A-2003-24135 | | 1/2003 |
| JP | A-2003-180447 | | 7/2003 |
| JP | A-2010-246655 | | 11/2010 |
| JP | A-2010-246723 | | 11/2010 |

OTHER PUBLICATIONS

International Search Report issued in International Patent Application No. PCT/JP2010/002746 dated Jul. 13, 2010 (with translation).
Dec. 19, 2013 Office Action issued in Chinese Patent Application No. 201080018433.X (with translation).

* cited by examiner

APPLICATOR-EQUIPPED CONTAINER

TECHNICAL FIELD

The present invention relates to an applicator-equipped container that includes the applicator for applying liquid or powdered contents contained in a container body to an object.

Priority is claimed on Japanese Patent Application No. 2009-111462, filed Apr. 30, 2009, the content of which is incorporated herein by reference.

BACKGROUND ART

As this kind of applicator-equipped container, a configuration is known which includes a container body that contains contents, and an applicator that is inserted from an inlet of the container body into the container body. In the above-described applicator, the tip of a rod of the applicator penetrates the inside of a wiping member and is inserted into the container body. In addition, the tip of the rod is provided with an applying portion formed in a writing brush shape, a brush shape, a sponge shape, or the like. As a usage method of the applicator-equipped container, first, the applicator is extracted from the inlet of the container body after attaching the contents to the applying portion of the tip of the applicator, Thereafter, the contents attached to the applying portion are applied to an object.

In the above-described applicator-equipped container, if extra contents are attached to the rod of the applicator, there is a concern that the extra contents attached to the rod may drip or may attach to one's hands or the like when applying the contents by using the applicator. Therefore, in the related art, for example, as described in Patent Document 1, a technology is suggested in which a tubular wiping member is mounted on the inside of the inlet of the container body. In the wiping member, an annular wiping piece is provided, which protrudes inward in the radial direction of the wiping member. In addition, by inserting the rod of the applicator in the inside of the wiping piece, the inner periphery of the wiping piece comes into contact with the outer peripheral surface of the rod so as to rub the outer peripheral surface of the rod. According to the applicator-equipped container including the above-described wiping member, when extracting the applicator from the inlet of the container body, the extra contents attached to the rod of the applicator can be rubbed off by the wiping piece.

Patent Documents

[Patent Document 1] Japanese Unexamined Utility Model Registration Application Publication No. 60-126109

SUMMARY OF THE INVENTION

Problems to be Resolved by the Invention

In the above-described applicator-equipped container of the related art, since the inner portion of the container body is sealed by the wiping piece and the applicator in a state where the applicator is inserted into the container body, the pressure of the inner portion of the container body is increased or decreased whenever the applicator is inserted or extracted. Specifically, when inserting the applicator, the pressure of the inner portion of the container body is excessively increased. Thereafter, when extracting the applicator, there is a concern that the contents may be scattered to the outside of the container body at the same time when the air of the inner portion of the container body is ejected.

The present invention is made in consideration of above-described problems of the related art. That is, an object of the present invention is to provide an applicator-equipped container capable of rubbing off extra contents when extracting the applicator from the container body and capable of preventing pressure of the inner portion of the container body from excessively increasing when inserting the applicator in the container body.

Means of Solving the Problems

According to the present invention, an applicator-equipped container includes: a container body that contains contents; an applicator that is inserted into the container body from an inlet of the container body; and an annular wiping piece that is disposed inside the container body and is elastically deformable so that an inner periphery of the wiping piece is rubbed to and comes into contact with the outer periphery of a rod of the applicator when inserting the rod of the applicator into the container body, wherein a protrusion protruding into an inner edge of the wiping piece is provided in the inner periphery of the wiping piece.

According to the feature of the present invention, when inserting the applicator into the inner portion of the container body while inserting the applicator into the wiping piece, the protrusion provided in the wiping piece can be pushed down by the rod of the applicator, and the wiping piece is elastically deformed so as to be turned downward in the axial direction by the outer peripheral surface of the applicator. In this case, in the periphery of the protrusion, a gap is generated between the wiping piece and the outer peripheral surface of the rod of the applicator. Therefore, when inserting the applicator in the inner portion of the container body, friction generated between the applicator and the wiping piece is decreased, pressure in the container body is decreased due to the gap, and an increase in the pressure of the inner portion of the container body is suppressed.

On the other hand, when extracting the applicator from the inner portion of the container body, the wiping piece is elastically deformed so as to be turned upward in the axial direction by the outer peripheral surface of the rod of the applicator, the rod of the applicator is moved so as to rub with respect to the inner periphery of the wiping piece, and contents attached to the outer peripheral surface of the rod of the applicator are rubbed off by the wiping piece. In this case, since the protrusion protrudes to the inside of an inner edge of the wiping piece, the protrusion can be pushed upward in the axial direction by the outer peripheral surface of the rod of the applicator when extracting the applicator. Therefore, the wiping piece is elastically deformed so as to be easily turned upward.

In addition, in the applicator-equipped container according to the present invention, it is preferable that only one protrusion is provided in the wiping piece.

With this configuration, when extracting the applicator, the protrusion can be easily pushed upward by the rod of the applicator.

In addition, in the applicator-equipped container according to the present invention, it is preferable that a stepped-portion including a lower surface of the protrusion and an inner edge surface of the wiping piece is formed between a tip of the protrusion and the inner edge of the wiping piece.

With this configuration, when the applicator is extracted and the protrusion is pushed upward by the rod of the applicator, the inner periphery of the wiping piece easily comes into close contact with the outer peripheral surface of the rod of the applicator over the entire circumference of the inner periphery. As a result, the contents attached to the rod of the applicator are easily rubbed off from the entire circumference of the rod.

In addition, in the applicator-equipped container according to the present invention, it is preferable that the protrusion is provided on an upper surface of the wiping piece.

With this configuration, when the applicator is inserted and the wiping piece is elastically deformed so as to be turned downward by the rod of the applicator, in the periphery of the protrusion, a gap is reliably generated between the wiping piece and the outer peripheral surface of the rod of the applicator.

Moreover, in the applicator-equipped container according to the present invention, it is preferable that the protrusion is provided so as to extend along the radial direction of the wiping piece.

With this configuration, the protrusion is easily pushed down when inserting the applicator, and the protrusion is easily pushed up when extracting the applicator. That is, since the protrusion is easily deformed up and down, the protrusion does not lock the applicator when inserting or extracting the applicator, and the wiping piece is easily elastically deformed.

Advantageous Effects of the Invention

According to the applicator-equipped container of the present invention, when inserting the applicator into the inner portion of the container body, it is possible to prevent the pressure of the inner portion of the container body from excessively increasing. The refore, when extracting the applicator from the container body, it is possible to prevent the contents from scattering to the outside of the container body.

DESCRIPTION OF EMBODIMENTS

Hereinafter, embodiments of the present invention will be described with reference to the accompanying drawings.

Figure 1:
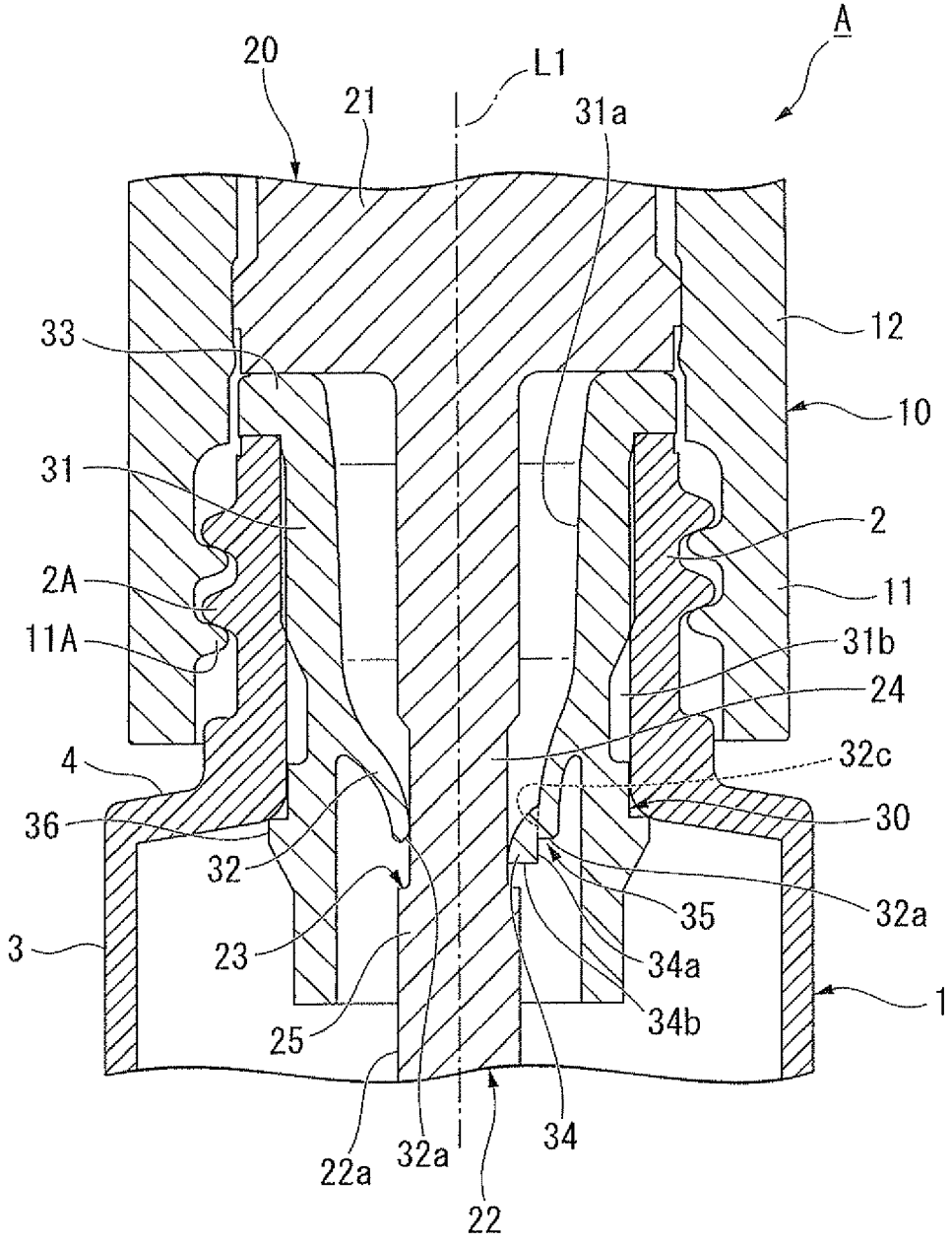
FIG. 1 is an enlarged cross-sectional view showing a main portion of an applicator-equipped container according to an embodiment of the present invention.

As shown in FIG. 1, an applicator-equipped container A according to an embodiment includes: a tubular container body 1 having a base; a cap 10 that is detachably mounted to an inlet 2 of the container body 1; a rod-shaped applicator 20 that is fixed to the cap 10; and a tubular wiping member 30 that is disposed in the inner portion of the container body 1. The container body 1, the cap 10, the applicator 20, and the wiping member 30 each are disposed on a common axis.

Hereinafter, the common axis is given as an axis line L1, the cap 10 side along the direction of the axis line L1 is given as an upper side, the bottom portion side of the container body 1 along the direction of the axis line L1 is given as a lower side, and a direction that is perpendicular to the axis line L1 is given as the radial direction.

In the container body 1, a shoulder 4 is formed in the upper end (the upper side in FIG. 1) of a body 3 receiving liquid contents, such as a cosmetic, a drug, a contacting liquid, and a cleaning liquid. The shoulder 4 and the body 3 have a continuous structure. The shoulder 4 is tapered so that the diameter of the shoulder 4 decreases in the upward direction. In addition, in the upper end of the shoulder 4, an approximately cylindrical inlet 2 is formed to extend upward along the axis line L1 of the container body 1. The inlet 2 and the shoulder 4 have a continuous structure. A male screw 2A is formed in an outer peripheral surface of the inlet 2.

As specific examples of the above-described cosmetic, mascara, eyeliner, lip gloss, or the like can be mentioned.

The cap 10 includes a tubular attachment portion 11 in which a female screw 11A is formed so as to screw to the male screw 2A of the inlet 2. Therefore, the cap 10 can be attached to or detached from the inlet 2. In addition, the cap 10 includes a tubular fixing portion 12, which is formed in the upper end of the tubular attachment portion 11 and is extended upward along the axis line L1. The tubular fixing portion 12 and the tubular attachment portion 11 have a continuous structure.

The applicator 20 includes: a cylindrical engagement portion 21 having a larger diameter that is engaged with the inside of the tubular fixing portion 12; a rod 22 that is installed so as to hang from a center portion of a lower end surface of the engagement portion 21; an applying portion (not shown) that is installed in a tip of the rod 22. The applicator 20 is extended downward along the axis line L1 in a state where the applicator 20 is fixed to the cap 10. In addition, in a state of mounting the cap 10 to the inlet 2, the rod 22 is inserted into the wiping member 30, and is inserted into the container body 1. As a specific example of the applying portion (not shown), a writing brush shape, a brush shape, and a sponge shape can be mentioned.

In the applicator 20, in the state of mounting the cap 10 on the inlet 2 of the container body 1, a stepped-portion 23 is formed in a portion which is positioned downward in the direction of the axis line L1 rather than a lower end of a wiping piece 32 of the rod 22 of the applicator 20. In the rod 22, an outer diameter of a portion 24 that is extended upward in the direction of the axis line L1 in the stepped-portion 23 is smaller than an outer diameter of a portion 25 that is extended downward in the direction of the axis line L1 in the stepped-portion 23.

Figure 2:
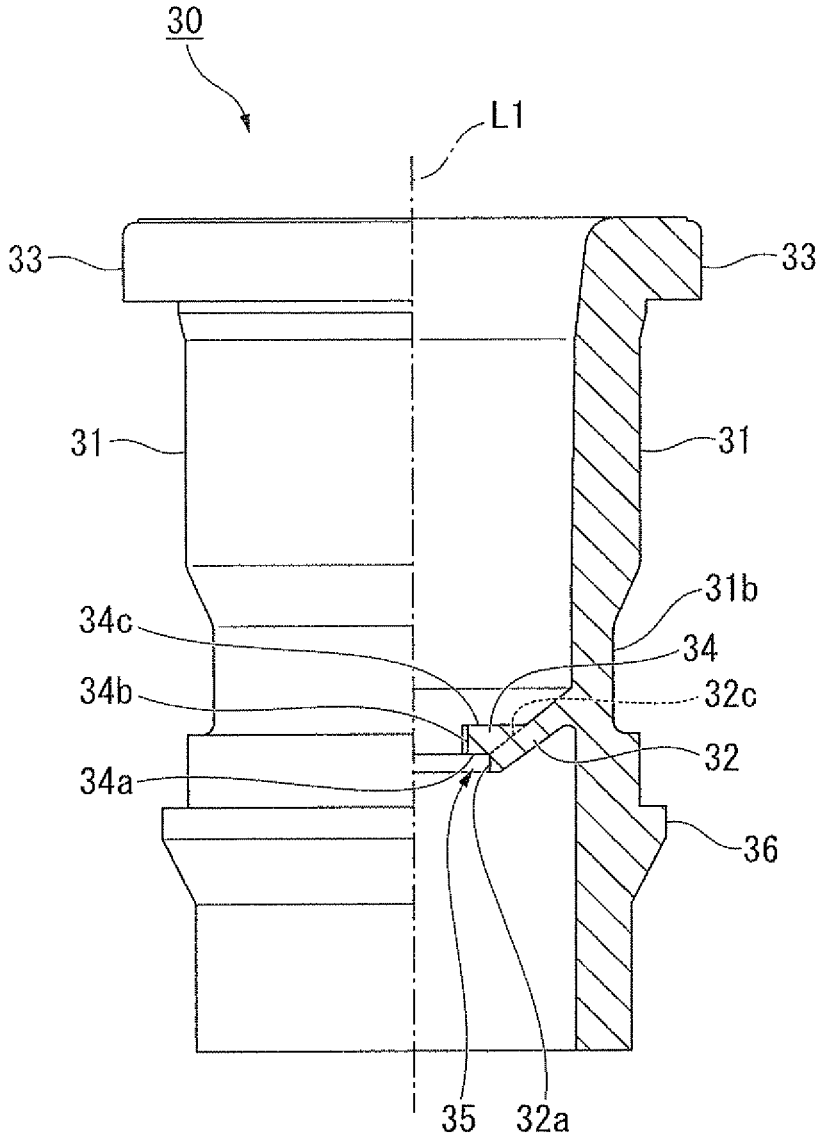
FIG. 2 is a partial cross-sectional view showing a wiping member constituting the applicator-equipped container of FIG. 1 in which the wiping member is cut in the axial direction.
Figure 3:
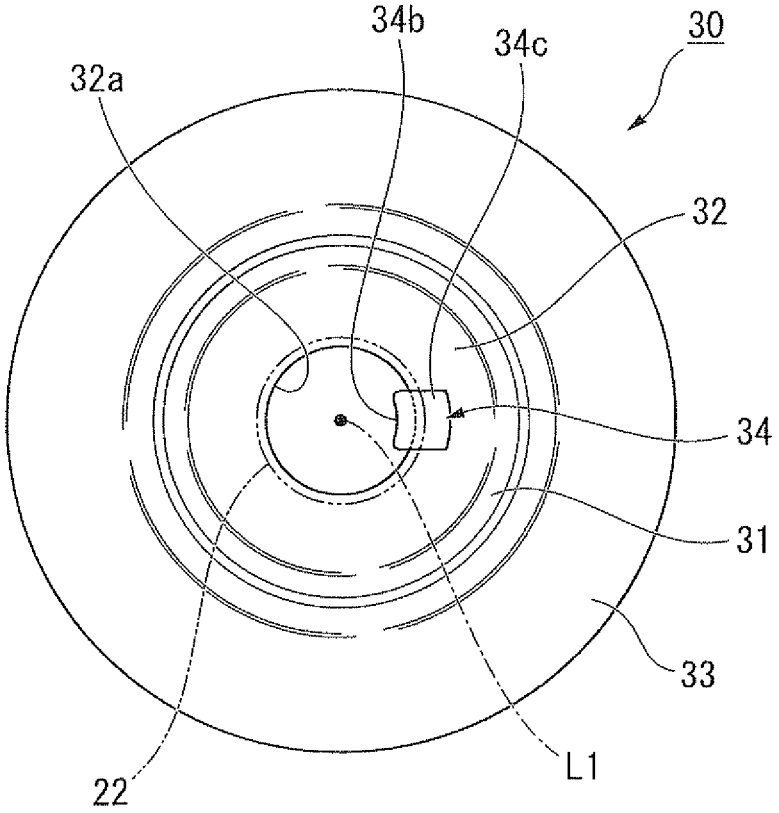
FIG. 3 is a top view showing the wiping member constituting the applicator-equipped container of FIG. 1 from above the axial direction.

The wiping member 30 is formed from elastic deformable soft materials such as nitrile rubber (NBR), low density polyethylene (LDPE), linear low density polyethylene (LLDPE). As shown in FIGS. 2 and 3, the wiping member 30 includes: a tubular portion 31 that is fixed to the inlet 2 and extends in the direction of the axis line L1; and an annular wiping piece 32 that is integrally formed in the tubular portion 31 and is elastically deformable.

The tubular portion 31 is engaged with the inlet 2, and a flange 33 is provided radially outward in an upper end of the tubular portion 31. The flange 33 comes into contact with an opening edge of the upper end of the inlet 2, and therefore, positioning of the direction of the axis line L1 of the wiping member 30 with respect to the inlet 2 is performed. In addition, a lower portion of the tubular portion 31 is protruded further downward compared to the inlet 2, and an annular stopper 36 is provided radially outward in the lower portion of the tubular portion 31. The stopper 36 approaches or comes into contact with an opening edge of a lower end of the inlet 2 from the lower side, and the wiping member 30 is prevented being removed from the inlet 2. Moreover, in the tubular portion 31, in an outer peripheral surface of a portion which is positioned between the opening edge of the upper end of the inlet 2 and the opening edge of the lower end of the inlet 2, a concave portion 31*b* is formed over the entire circumference of the outer peripheral surface. Therefore, a gap in the radial direction is formed between the tubular portion 31 and the inlet 2.

The wiping piece 32 is installed in an intermediate portion in the direction of the axis line L1 in the inner peripheral surface 31*a* of the tubular portion 31. In the present embodiment, the wiping piece 32 is connected to a portion corresponding to the concave portion 31*b* in the inner peripheral surface 31*a* of the tubular portion 31. The wiping piece 32 is extended in a linear shape so as to face the radially inward side of the container body 1 as moving downward in the direction of the axis line L1 of the container body 1. In addition, the wiping piece 32 is formed as a taper shape in which the diameter of the wiping piece 32 becomes smaller as moving downward in the direction of the axis line L1 of the wiping member 30. The rod 22 of the applicator 20 is inserted into the wiping piece 32 in a state where the above-described applicator 20 is contained in the inner portion of the container body 1. Here, the diameter of an inner edge surface 32*a* of the wiping piece 32, that is, an inner diameter in the lower end of the direction of the axis line L1 is formed so as to be smaller than an outer diameter of the rod 22 of the applicator 20. Therefore, the wiping piece 32 is elastically deformed, and the rod 22 of the applicator 20 can be inserted into the inner edge surface 32*a* of the wiping piece 32.

Figure 4:
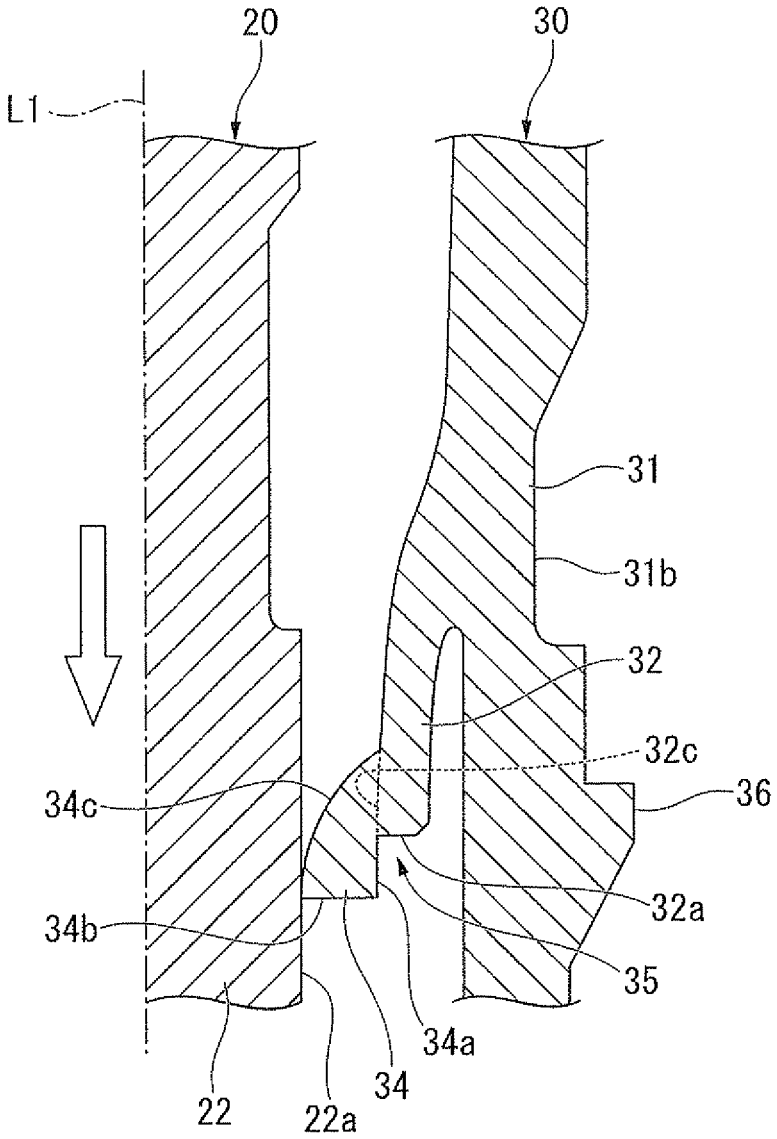
FIG. 4 is a main part enlarged cross-sectional view showing a contact state between the applicator and the wiping piece when moving the applicator downward in the axial direction of the applicator-equipped container of FIG. 1.

The wiping piece 32 is formed so as to be elastically deformed in association with a movement of the applicator 20 in the direction along the axis line L1. That is, in a state of inserting the rod 22 of the applicator 20 into the wiping piece 32, when the applicator 20 moves downward along the axis line L1, the wiping piece 32 is elastically deformed so that the wiping piece 32 is turned downward in the direction of the axis line L1 of the container body 1 by the outer peripheral surface 22*a* of the rod 22 of the applicator 20 (refer to FIG. 4). In addition, when the applicator 20 moves upward along the axis line L1, the wiping piece 32 is elastically deformed so that the wiping piece 32 is turned upward in the direction of the axis line L1 of the container body 1 (refer to FIG. 5).

Moreover, as shown in FIGS. 2 and 3, in an upper surface 32*c* of an inner portion in the radial direction of the wiping piece 32, that is, in a lower end portion of the inner peripheral surface of the wiping piece 32 having the taper shape, only one protrusion 34, which protrudes to the inside of the inner edge of the wiping piece 32, is provided. The protrusion 34 is an elastic deformable plate-shaped portion which is formed so as to extend along the radial direction of the wiping piece 32, and the protrusion 34 is overhung toward the radial inside from the upper surface of the inner periphery of the wiping piece 32. The protrusion 34 is integrally connected with respect to the wiping piece 32. In addition, when viewing the protrusion 34 in plan view as shown in FIG. 3, the protrusion 34 is formed in an approximately rectangular shape, and a tip of the protrusion 34 is disposed in the inside of the inner edge of the wiping piece 32. A stepped-portion 35 is formed between the tip of the protrusion 34 and the inner edge of the wiping piece 32, and the stepped-portion 35 includes a lower surface 34*a* of the protrusion 34 and the inner edge surface 32*a* of the wiping piece 32. That is, the lower surface 34*a* of the protrusion 34 protrudes toward the radial inside from the upper end of the inner edge surface 32*a* of the wiping piece 32.

Moreover, as shown in FIG. 1, in a state of mounting the cap 10 on the inlet 2 of the container body 1, the upper surface 32*c* of the wiping piece 32 can be abutted to the portion 24, which is extended to the stepped-portion 23 from above the direction of the axis line L1 in the outer peripheral surface 22*a* of the rod 22 of the applicator 20. In addition, the inner edge surface 32*a* in the wiping piece 32 and a tip surface 34*b* of the protrusion 34 face the stepped-portion 23 in the direction of the axis line L1.

In the applicator-equipped container A constituted as described above, as shown in FIG. 4, the protrusion 34 installed in the wiping piece 32 can be pushed down by the rod 22 of the applicator 20, and the wiping piece 32 is elastically deformed so that the wiping piece 32 is turned downward in the direction of the axis line L1 of the container body 1 by the outer peripheral surface 22*a* of the rod 22 of the applicator 20. In this case, the concave portion 31*b* is formed in a portion to which the wiping piece 32 is connected in the outer peripheral surface of the tubular portion 31, and the forming portion of the concave portion 31*b* is easily deformed. Therefore, the wiping piece 32 is easily elastically deformed. Moreover, in this case, in the periphery of the protrusion 34, the gap is formed between the wiping piece 32 and the outer periphery 22*a* of the rod 22 of the applicator 20. Therefore, when inserting the applicator 20 into the inner portion of the container body 1, friction generated between the applicator 20 and the wiping piece 32 is decreased, the pressure in the container body 1 is decreased due to the above-described gap, and the pressure increase in the container body 1 is suppressed.

Here, since the protrusion 34 is provided on the upper surface of the wiping piece 32, when the applicator 20 is inserted and the wiping piece 32 is elastically deformed so as to be turned downward by the rod 22 of the applicator 20, in the periphery of the protrusion 34, a gap is reliably formed between the wiping piece 32 and the outer peripheral surface 22*a* of the rod 22 of the applicator 20.

In addition, since the protrusion 34 is provided so as to extend along the radial direction of the wiping piece 32, the protrusion 34 is easily deformed downward. Therefore, when inserting the applicator 20, the protrusion 34 does not lock the applicator 20, the protrusion 34 is easily pushed down, and the wiping piece 32 is easily elastically deformed.

Figure 5:
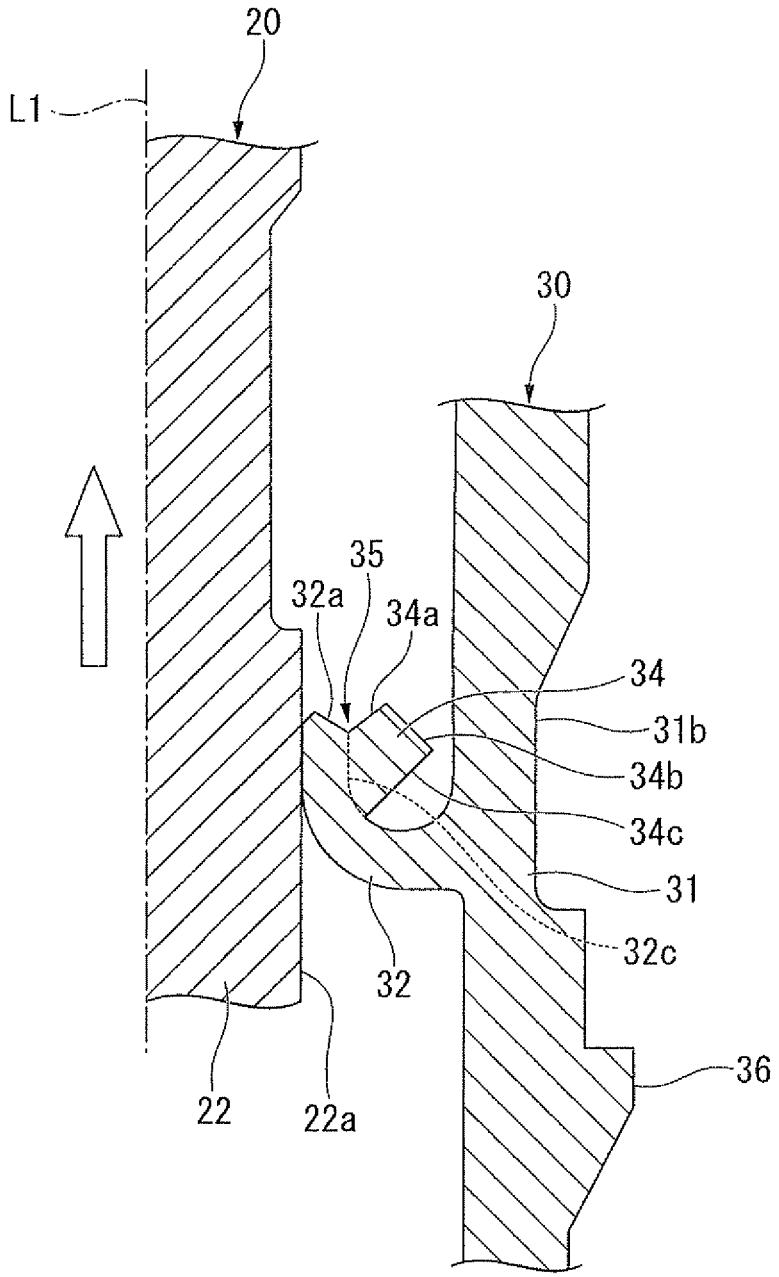
FIG. 5 is a main part enlarged cross-sectional view showing a contact state between the applicator and the wiping piece when moving the applicator upward in the axial direction of the applicator-equipped container of FIG. 1.

On the other hand, as shown in FIG. 5, when extracting the applicator 20 from the inner portion of the container body 1, the wiping piece 32 is elastically deformed so as to be turned upward in the axial direction by the outer peripheral surface 22*a* of the rod 22 of the applicator 20, the rod 22 of the applicator 20 is moved so as to rub the inner periphery of the wiping piece 32, and the contents attached to the outer peripheral surface 22*a* of the rod 22 of the applicator 20 is rubbed off by the wiping piece. In this case, since the protrusion 34 is protruded to the inside of the inner edge of the wiping piece 32, the protrusion 34 is pushed upward in the axial direction by the outer peripheral surface 22*a* of the rod 22 of the applicator 20 when extracting the applicator 20. Therefore, the wiping piece 32 is elastically deformed so as to be easily turned upward. In addition, since the concave portion 31*b* is formed in the portion to which the wiping piece 32 is connected in the outer peripheral surface of the tubular portion 31, when the wiping piece 32 is elastically deformed so as to be turned upward in the axial direction, the tubular portion 31 is deformed so that the diameter of the forming portion of the concave portion 31*b* is increased. Therefore, the wiping piece 32 is easily elastically deformed so as to be turned upward in the axial direction.

Here, since only one protrusion 34 is installed to the wiping piece 32, when extracting the applicator 20, the protrusion 34 is easily pushed upward by the rod 22 of the applicator 20.

In addition, since the stepped-portion 35 including the lower surface 34*a* of the protrusion 34 and the inner edge surface 32*a* of the wiping piece 32 is formed between the tip of the protrusion 34 and the inner edge of the wiping piece 32, when the applicator 20 is extracted and the protrusion 34 is pushed upward by the rod 22 of the applicator 20, the inner periphery of the wiping piece 32 easily comes into close contact with the outer peripheral surface 22*a* of the rod 22 of the applicator 20 over the entire circumference. As a result, the contents attached to the rod 22 of the applicator 20 are easily rubbed off from the entire circumference.

In addition, since the protrusion 34 is provided so as to extend along the radial direction of the wiping piece 32, the protrusion 34 is easily deformed upward. Therefore, when extracting the applicator 20, the protrusion 34 does not lock the applicator 20, the protrusion 34 is easily pushed up, and the wiping piece 32 is easily inversely deformed.

According to the above-described applicator-equipped container A, when inserting the applicator 20 to the inner portion of the container body 1, in the periphery of the protrusion 34, a gap is generated between the wiping piece 32 and the outer peripheral surface 22*a* of the rod 22 of the applicator 20. Thereby, it is possible to prevent the pressure of the inner portion of the container body 1 from increasing excessively, and when extracting the applicator 20 from the container body 1, it is possible to prevent the contents from scattering to the outside of the container body 1.

In addition, since only one protrusion 34 is provided in the wiping piece 32, when extracting the applicator 20, the protrusion 34 is easily pushed upward. Therefore, the applicator 20 is easily extracted, and it is possible to improve operability.

In addition, since the stepped-portion 35 including the lower surface 34*a* of the protrusion 34 and the inner edge surface 32*a* of the wiping piece 32 is formed between the tip of the protrusion 34 and the inner edge of the wiping piece 32, the inner periphery of the wiping piece 32 easily comes into close contact with the outer peripheral surface 22*a* of the rod 22 of the applicator 20 over the entire circumference when extracting the applicator 20. Therefore, the contents attached to the rod 22 of the applicator 20 can be rubbed off from the entire circumference, and it is possible to reliably prevent the contents from sagging and falling.

In addition, the protrusion 34 is provided so as to extend along the radial direction of the wiping piece 32, and when inserting or extracting the applicator 20, the protrusion 34 does not lock the applicator 20, and the wiping piece 32 is easily elastically deformed. Therefore, the applicator 20 can be easily inserted or extracted, and it is possible to improve operability.

Moreover, while extracting the applicator 20, the tip surface 34*b* of the protrusion 34 is caught in the stepped-portion 23. Therefore, the protrusion 34 is pushed up by the stepped-portion 23, and the wiping piece 32 is turned upward in the direction of the axis line L1 of the container body 1. Thereby, extra liquid attached to the outer peripheral surface of the applicator 20 can be further reliably rubbed off by the wiping piece 32.

In addition, the wiping piece 32 is extended in a linear shape so as to face the radially inward side of the container body 1 as going downward in the direction of the axis line L1 of the container body 1. Therefore, as described above, when the tip surface 34*b* of the protrusion 34 is caught in the stepped-portion 23, it is possible to add a bending force to the wiping piece, and it is possible to easily and reliably turn the wiping piece 32 upward in the direction of the axis line L1 during extracting the applicator 20.

As described above, the embodiment of the applicator-equipped container according to the invention is explained. However, the invention is not limited to the embodiment, and the invention can be appropriately modified within a scope which does not depart from the gist of the invention.

Figure 6:
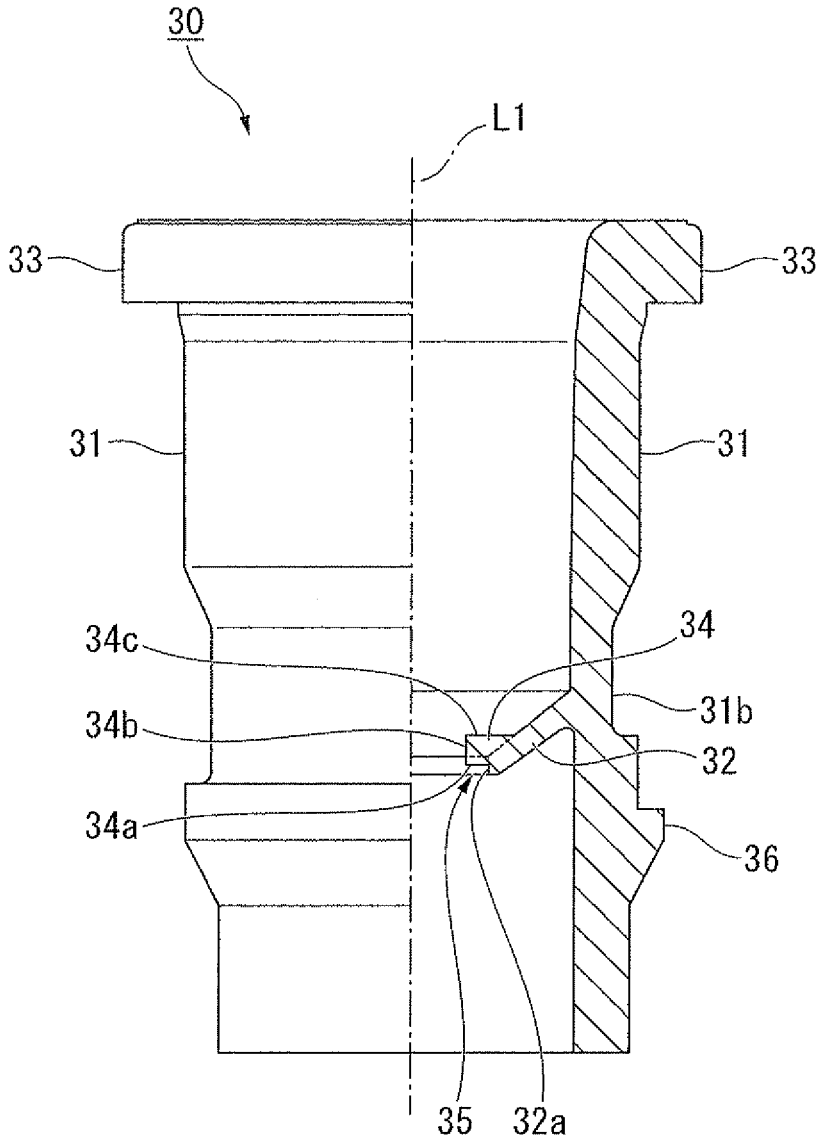
FIG. 6 is a partial cross-sectional view showing a wiping member for explaining another embodiment of the present invention.

For example, in the above-described embodiment, the lower surface 34*a* of the protrusion 34 protrudes toward the radial inside from the upper end of the inner edge surface 32*a* of the wiping piece 32. However, according to another embodiment of the present invention, as shown in FIG. 6, the lower surface 34*a* of the protrusion 34 may be constituted so as to protrude from an intermediate part of the axial direction in the inner edge surface 32*a* of the wiping piece 32 toward the radial inside.

Figure 7:
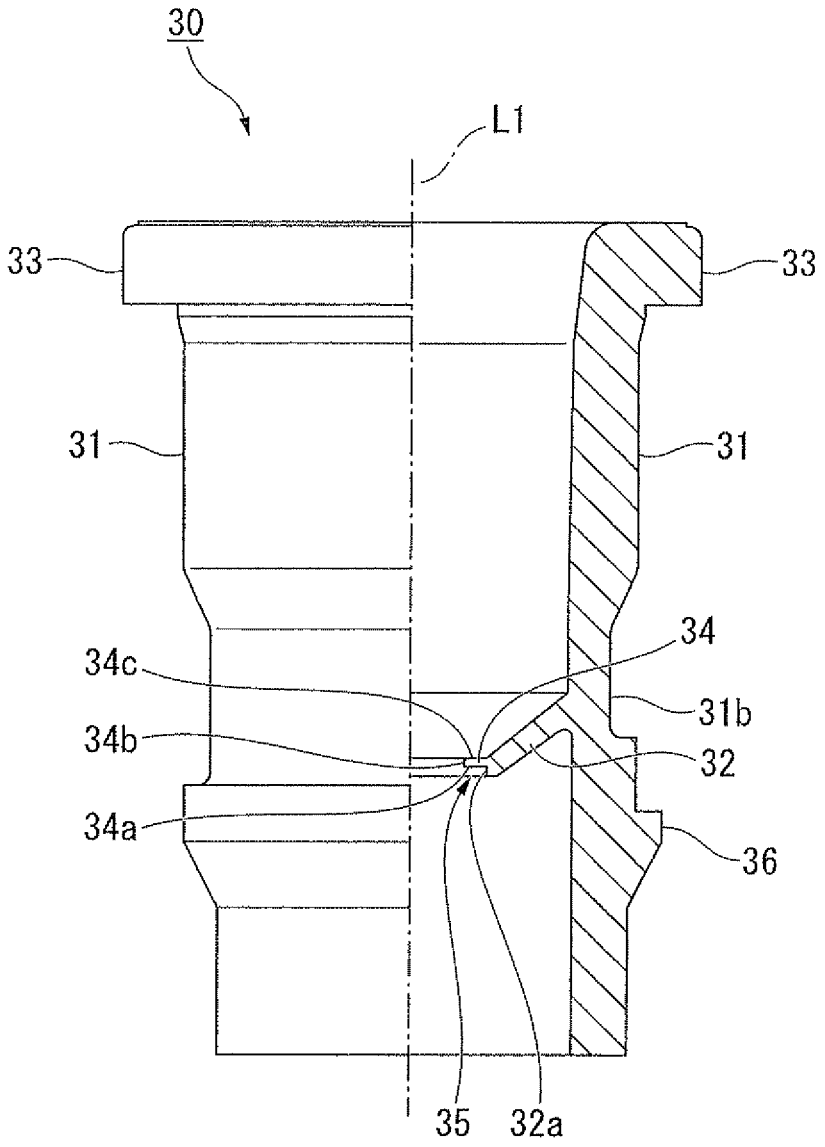
FIG. 7 is a partial cross-sectional view showing a wiping member for explaining another embodiment of the present invention.

In addition, in the above-described embodiments, the protrusion 34 is provided in the upper surface 32*c* of the inward portion in the radial direction of the wiping piece 32, and the upper surface 34*c* of the protrusion 34 is installed so as to extend from the intermediate portion in the radial direction in the upper surface of the taper shape of the wiping piece 32 toward the radial inside. However, according to another embodiment, as shown in FIG. 7, the protrusion 34 may be installed in the inner edge surface 32*a* of the wiping piece 32, and the upper surface 34*c* of the protrusion 34 may protrudes from the upper end of the inner edge surface 32*a* of the wiping piece 32 toward the radial inside.

Figure 8:
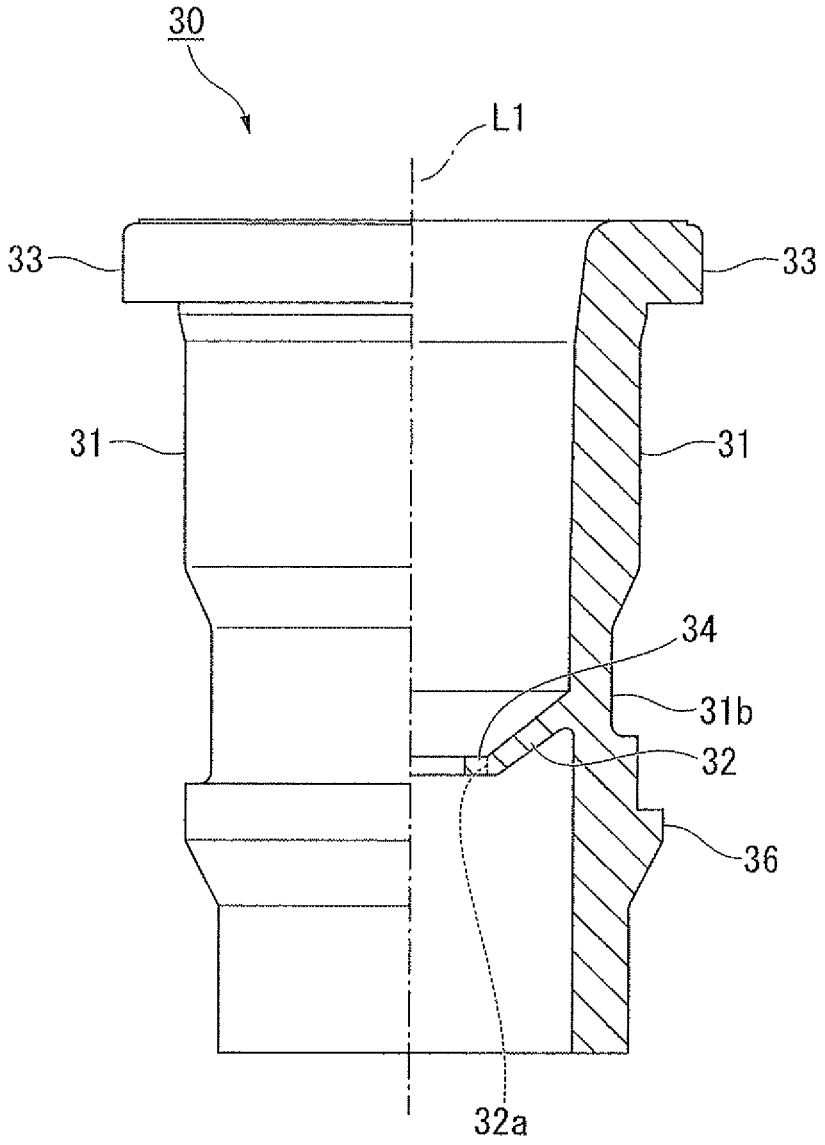
FIG. 8 is a partial cross-sectional view showing a wiping member for explaining another embodiment of the present invention.

In addition, in the above-described embodiments, the stepped-portion 35, which includes the lower surface 34*a* of the protrusion 34 and the inner edge surface 32*a* of the wiping piece 32, is formed between the tip of the protrusion 34 and the inner edge of the wiping piece 32. However, according to another embodiment, as shown in FIG. 8, the protrusion 34 may be installed in the inner edge surface 32*a* of the wiping piece 32, and a stepped-portion may be not formed between the tip of the protrusion 34 and the inner edge of the wiping piece 32.

Figure 9:
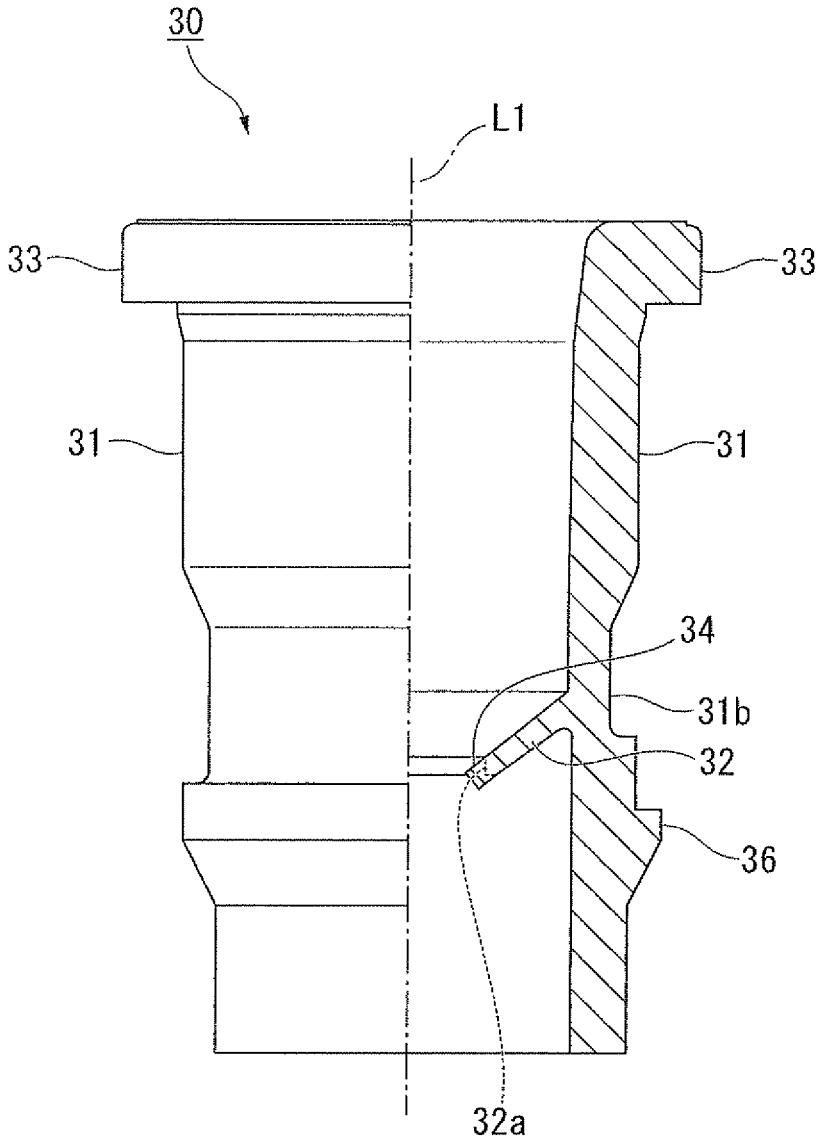
FIG. 9 is a partial cross-sectional view showing a wiping member for explaining another embodiment of the present invention.
Figure 10:
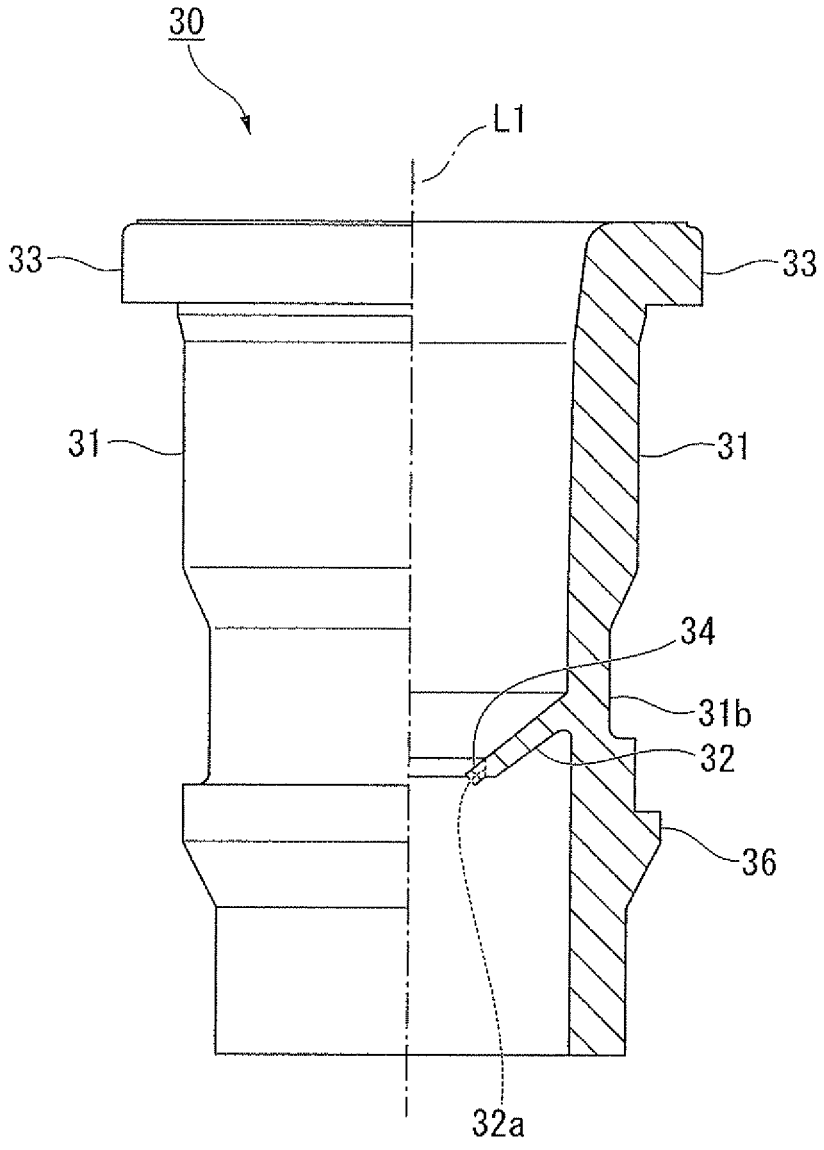
FIG. 10 is a partial cross-sectional view showing a wiping member for explaining another embodiment of the present invention.

In the above-described embodiments, the protrusion 34 is provided so as to extend along the radial direction of the wiping piece 32. However, according to another embodiment, as shown FIGS. 9 and 10, the protrusion 34 may be provided so as to extend along the upper surface of the taper shape of the wiping piece 32, and the upper surface of the wiping piece 32 may be flush with the upper surface of the protrusion 34.

In addition, in the above-described embodiments, only one protrusion 34 is installed in the wiping piece 32. However, according to another embodiment of the present invention, a plurality of protrusions 34 may be provided in the wiping piece 32.

Moreover, in the above-described embodiments, the wiping piece 32 includes the taper shape in which the diameter of the wiper piece 32 becomes small as moving downward. However, according to another embodiment of the present invention, the wiping piece having an annular plate shape may be provided so as to be perpendicular to the axis line L1.

In addition, in the above-described embodiments, the wiping piece 32 is disposed in the intermediate portion of the axial direction of the wiping member 30, and the wiping piece 32 is disposed in the inside of the inlet 2. However, according another embodiment of the present invention, the wiping piece 32 may be disposed in the lower end or the upper end in the axial direction of the wiping member 30, and the wiping piece 32 may be disposed in the lower portion or the upper portion of the inlet 2.

Moreover, in the above-described embodiments, the wiping piece 32 is formed in the wiping member mounted on the inlet 2. However, according to another embodiment of the present invention, the wiping piece 32 may be integrally formed with the container body 1. For example, by forming the wiping piece in the inside of the inlet 2, the wiping member can be omitted.

In addition, in the above-described embodiments, the engagement portion 21 of the applicator 20 is engaged with the inside of the cap 10, and the applicator 20 is attached to the cap 10. However, in another embodiment of the present invention, the cap 10 and the applicator 20 may be separated from each other, when applying the contents by the applicator 20, the upper end portion of the applicator 20 may be gripped. In addition, the cap 10 and the applicator 20 may be integrally molded.

Moreover, in the above-described embodiments, the concave portion 31*b* is formed in the outer peripheral surface of the tubular portion 31 of the wiping member 30, and the gap in the radial direction is provided between the tubular portion 31 and the inlet 2. However, according to another embodiment of the invention, by forming an annular concave portion in the inlet 2, a gap in the radial direction may be formed between the tubular portion 31 and the inlet 2. In addition, the concave portion may not be annular, may be partially provided, and may not be provided.

In addition, in the above-described embodiments, the stopper 36 is provided in the tubular portion 31. However, according to another embodiment of the present invention, the stopper 36 may not be provided.

Moreover, in the above-described embodiments, the liquid contents are contained in the inside of the container body 1. However, according to another embodiment of the present invention, the contents are not limited to liquid contents, for example, powdered contents may be contained in the inside of the container body 1.

In addition, it is possible to appropriately replace the components of above-described embodiments with well-known components within the scope which is not departed from the gist of the invention, and the above-described modifications may be appropriately combined Industrial Applicability According to the applicator-equipped container of the present invention, it is possible to rub off extra contents when extracting the applicator from the container body. In addition, when inserting the applicator to the inner portion of the container body, it is possible to prevent the pressure of the inner portion of the container body from excessively increasing. Therefore, when extracting the applicator from the container body, it possible to prevent the contents from scattering to the outside of the container body. Thus, the embodiments of the present invention can be applied to the applicator-equipped container, which contains liquid contents such as a cosmetic, a drug, a contacting liquid, and a cleaning liquid, or powered contents.

REFERENCE SIGNS LIST

1: Container Body
2: Inlet
20: Applicator
22: Rod
32: Wiping Piece
34: Protrusion
35: Stepped-Portion

The invention claimed is:

1. An applicator-equipped container for containing a content, the applicator-equipped container comprising:

a container body configured to contain the content, and having an inlet;

an applicator configured to be inserted in the inlet of the container body, and having a rod; and a wiping piece disposed in the container body and formed in an annular shape in which an inner part of the wiping piece is capable of contacting and being rubbed on an outer periphery of the rod, and the wiping piece being configured to elastically deform in response to contact with the rod, the wiping piece provided with a protrusion configured to protrude from an inner part of the wiping piece to an inside of an inner circumference of the wiping piece.

2. The applicator-equipped container according to claim 1, wherein only one protrusion is provided in the wiping piece.

3. The applicator-equipped container according to claim 2, wherein a stepped-portion formed by a lower surface of the protrusion and an inner edge surface of the wiping piece is formed between a tip of the protrusion and the inner circumference of the wiping piece.

4. The applicator-equipped container according to claim 3, wherein the protrusion is provided on an upper surface of the wiping piece.

5. The applicator-equipped container according to claim 4, wherein the protrusion is provided so as to extend along a radial direction of the wiping piece.

6. The applicator-equipped container according to claim 3, wherein the protrusion is provided so as to extend along a radial direction of the wiping piece.

7. The applicator-equipped container according to claim 2, wherein the protrusion is provided on an upper surface of the wiping piece.

8. The applicator-equipped container according to claim 7, wherein the protrusion is provided so as to extend along a radial direction of the wiping piece.

9. The applicator-equipped container according to claim 2, wherein the protrusion is provided so as to extend along a radial direction of the wiping piece.

10. The applicator-equipped container according to claim 1, wherein a stepped-portion formed by a lower surface of the protrusion and an inner edge surface of the wiping piece is formed between a tip of the protrusion and the inner circumference of the wiping piece.

11. The applicator-equipped container according to claim 10, wherein the protrusion is provided on an upper surface of the wiping piece.

12. The applicator-equipped container according to claim 11, wherein the protrusion is provided so as to extend along a radial direction of the wiping piece.

13. The applicator-equipped container according to claim 10, wherein the protrusion is provided so as to extend along a radial direction of the wiping piece.

14. The applicator-equipped container according to claim 1, wherein the protrusion is provided on an upper surface of the wiping piece.

15. The applicator-equipped container according to claim 14, wherein the protrusion is provided so as to extend along a radial direction of the wiping piece.

16. The applicator-equipped container according to claim 1, wherein the protrusion is provided so as to extend along a radial direction of the wiping piece.

17. The applicator-equipped container according to claim 1, wherein a gap is formed between the wiping piece and the outer peripheral surface of the rod in response to inserting the applicator downwards in an axial direction.

18. The applicator-equipped container according to claim 1, wherein during extraction of the rod from the container body, the inner part of the wiping piece is rubbed on and comes into contact with the outer periphery of the rod of the applicator, and during insertion of the rod into the inside of the container body, both a part of the inner part of the wiping piece and the protrusion come into contact with the outer periphery of the rod of the applicator.

* * * * *